US006352235B2

(12) United States Patent
Cizek

(10) Patent No.: US 6,352,235 B2
(45) Date of Patent: Mar. 5, 2002

(54) COMBINATION BOTTLE HOOK AND WRENCH

(76) Inventor: Brian P. Cizek, 6572 Brad Dr., Huntington Beach, CA (US) 92647

( * ) Notice: Subject to any disclaimer, the term of this patent is extended or adjusted under 35 U.S.C. 154(b) by 0 days.

(21) Appl. No.: 09/894,954

(22) Filed: Jun. 28, 2001

Related U.S. Application Data

(63) Continuation of application No. 09/183,858, filed on Oct. 30, 1998.

(51) Int. Cl.[7] ..... B67B 7/14; A47K 7/08

(52) U.S. Cl. ..... 248/692; 248/312; 81/3.4; 81/3.09; 215/398

(58) Field of Search ..... 248/692, 690, 248/312, 313, 304, 305, 301, 316.7; 81/3.4, 3.09; 224/148.7; 215/398

(56) References Cited

U.S. PATENT DOCUMENTS

| | | | | | |
|---|---|---|---|---|---|
| 924,348 | A | | 6/1909 | Green | 248/312 X |
| 1,236,929 | A | * | 8/1917 | Hauck | 248/312 |
| 1,304,064 | A | | 5/1919 | Kearn | 248/312 |
| 1,919,866 | A | * | 7/1933 | Schacht | 81/3.4 |
| 2,406,696 | A | | 8/1946 | Leslie | 294/27.1 |
| 3,304,039 | A | * | 2/1967 | Edelman et al. | 248/312 X |
| 3,812,741 | A | * | 5/1974 | Heine | 81/3.4 |
| 3,990,596 | A | * | 11/1976 | Hoftman | 215/11.1 |
| 4,273,246 | A | * | 6/1981 | Thompson | 215/398 |
| 4,368,826 | A | | 1/1983 | Thompson | 215/398 X |
| 4,486,043 | A | | 12/1984 | Rais | 294/27.1 |
| 4,507,988 | A | * | 4/1985 | LoFaso et al. | 81/3.09 |
| D288,278 | S | | 2/1987 | Bright | 294/33 X |
| 4,723,465 | A | * | 2/1988 | Hughes | 81/3.09 |
| 4,773,549 | A | | 9/1988 | Avraham | 215/396 |
| 4,821,372 | A | * | 4/1989 | Casiello | 215/396 X |
| 4,911,038 | A | * | 3/1990 | Ferrin | 81/3.09 |
| 4,955,572 | A | | 9/1990 | Simmons | 248/312 |
| 4,979,407 | A | * | 12/1990 | Hernandez et al. | 81/3.09 |
| 5,056,383 | A | * | 10/1991 | Halpin | 81/3.43 |
| 5,301,857 | A | | 4/1994 | Green | 224/148.4 |
| 5,487,482 | A | * | 1/1996 | Rocheleau | 215/396 |
| 5,816,631 | A | | 10/1998 | Kochan | 294/33 |
| 5,897,150 | A | | 4/1999 | Rubini | 294/27.1 |
| 6,019,335 | A | * | 2/2000 | Schati | 248/312 |
| 6,105,468 | A | * | 8/2000 | Fohrman et al. | 81/3.09 |
| 6,279,794 | B1 | * | 8/2001 | Miyazaki | 224/148.7 |

FOREIGN PATENT DOCUMENTS

| | | | | |
|---|---|---|---|---|
| JP | 9040084 A | * | 2/1997 | |
| WO | WO 83/02101 | | 6/1983 | 294/27.1 |

* cited by examiner

*Primary Examiner*—Anita King
(74) *Attorney, Agent, or Firm*—Richard E. Bee

(57) ABSTRACT

A combination bottle hook and bottle cap wrench device is provided for suspending a plastic beverage bottle from a nearby structure which is convenient to a person wishing to use the contents of the bottle and for providing a wrench mechanism for aiding the user to loosen the bottle cap of the beverage bottle. The device is comprised of an L-shaped piece of plastic material having first and second legs extending at substantially right angles relative to one another. One leg has an open-ended C-shaped head portion for clamping around the neck of the beverage bottle. The other leg forms a retaining member for placement behind a portion of the structure on which it is desired to hook the beverage bottle. The inner surface of the C-shaped head portion is serrated or notched for purposes of gripping the bottle cap when it is desired to loosen the bottle cap.

20 Claims, 5 Drawing Sheets

COMBINATION BOTTLE HOOK AND WRENCH

RELATED APPLICATION

The present application is a continuation of earlier-filed copending application Ser. No. 09/183,858, filed on Oct. 30, 1998 and entitled "Bottle Hook" and of earlier filed copending application Ser. No. 29/137,928, filed on Feb. 28, 2001 and entitled "Combination Bottle Hook and Wrench".

TECHNICAL FIELD

This invention relates to devices for suspending and opening liquid dispensing bottles.

BACKGROUND OF THE INVENTION

A need frequently arises for supporting a liquid dispensing bottle in a manner so that it is readily available to a person wishing to use the contents of the bottle. One example of such a situation is the case of a plastic water bottle containing purified water used for human drinking purposes. It is not always possible for the person wishing to have the water bottle near him to hold the water bottle in his hands. A frequent solution is to set the water bottle on the floor or ground near the user. This, however, has disadvantages. The user may be engaged in another activity and it may be awkward for him to reach down and pick up the water bottle when he wishes to take a drink. Also, the water bottle may present an obstacle for other people passing nearby. And for the case where the user is engaged in an activity which involves moving considerable distances from one place to another, the setting of the bottle on the ground is not a practical solution.

Another problem with drink bottles is that it is sometimes difficult to remove the cap from the bottle for purposes of drinking the contents. The cap is tightly threaded onto a threaded neck portion of the bottle and, for one reason or another, the user cannot break the seal. Maybe his hands are sweaty or a bit greasy and he cannot get a good grip on the cap. Or maybe a physical impairment prevents him from getting a sufficiently tight grip. In these and similar cases, it would be desirable to provide a simple, inexpensive device for loosening or removing the cap from the bottle. This is particularly desirable for initially breaking the safety seal of the bottle cap.

SUMMARY OF THE INVENTION

The present invention provides a simple and inexpensive combination bottle hook and bottle cap wrench for a drink bottle having a threaded neck portion and a bottle cap or closure member threaded onto such neck portion. The bottle hook feature enables the user to hook the bottle onto the frame of a stationary exercise machine, the handle bar of a bicycle, the open upper end of a golf bag, a belt being worn by the user when jogging, and so forth. The bottle cap wrench feature enables the user to quickly and easily remove the bottle cap, even though his hands may be sweaty or oily.

The combination device of this invention is comprised of an L-shaped piece of plastic material having first and second legs extending at substantially right angles relative to one another. The first leg is a flat elongated member having an enlarged open-ended C-shaped head portion for pushing onto and clamping around a neck of a drink bottle when it is desired to hook the drink bottle onto a support structure. The inner surface of the C-shaped head portion is serrated or notched for gripping the bottle cap by placement of the C-shaped head portion on the bottle cap and using the first leg as a wrench when it is desired to loosen or remove the bottle cap. The second leg of the L-shaped piece of plastic material is a flat elongated member providing a retaining member for placement behind a portion of the structure on which it is desired to hook the drink bottle.

For a better understanding of the present invention, together with other and further advantages and features thereof, reference is made to the following description taken in connection with the accompanying drawings, the scope of the invention being pointed out in the appended claims.

BRIEF DESCRIPTION OF THE DRAWINGS

Referring to the drawings.

DETAILED DESCRIPTION OF THE PREFERRED EMBODIMENTS

Figure 1:
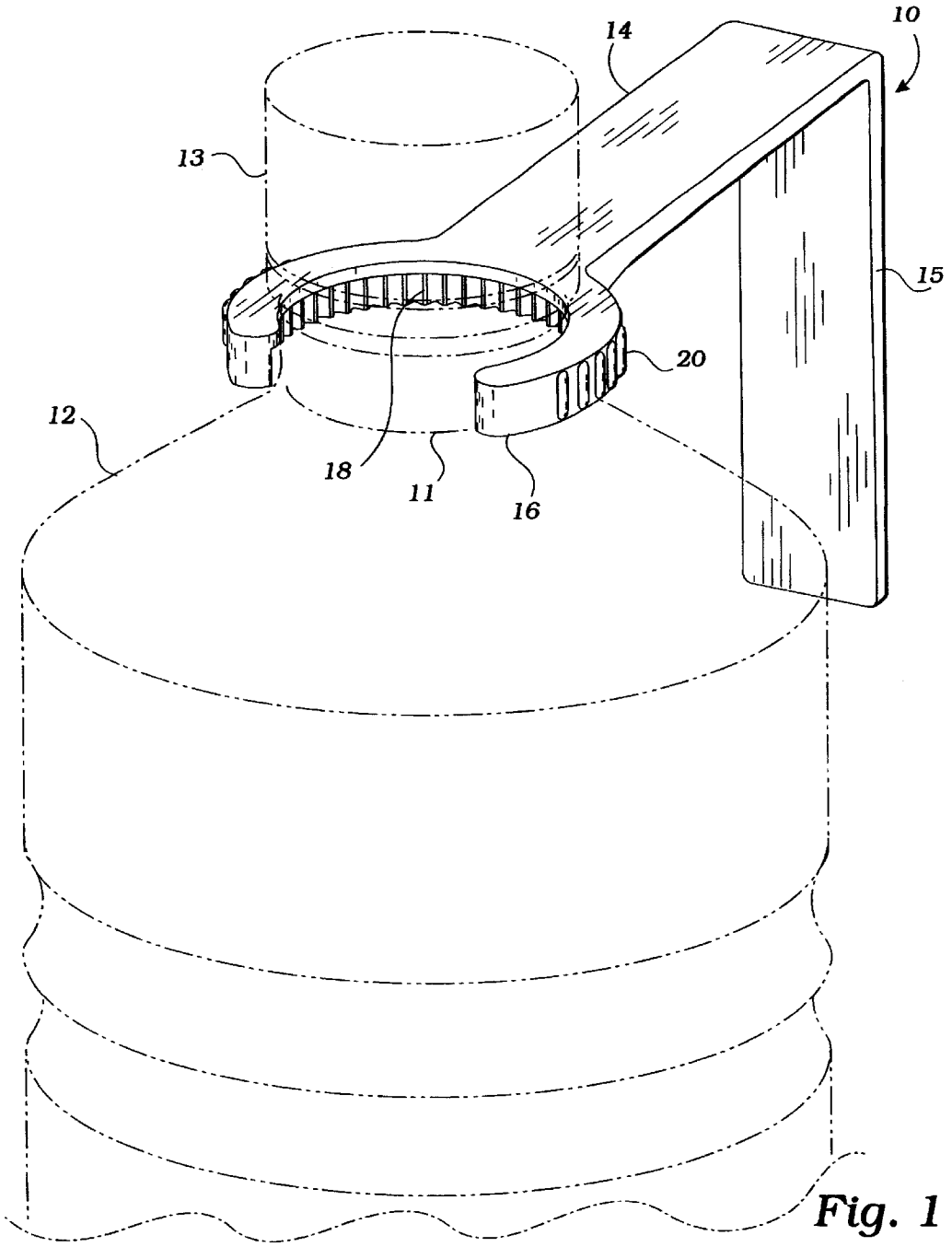
FIG. 1 is a perspective view of a first embodiment of a combination bottle hook and bottle cap wrench constructed in accordance with the present invention, the combination being shown in a bottle hooking position.

Referring to FIGS. 1–6, there is shown a first embodiment of a combination bottle hook and bottle cap wrench 10 constructed in accordance with the present invention. FIG. 1 shows the combination hook and wrench 10 in its bottle hooking position wherein the combination hook and wrench 10 is pushed onto and clamped around the neck 11 of a plastic beverage or drink bottle 12. The neck 11 is of reduced diameter relative to the body of drink bottle 12 and the upper portion of neck 11 is threaded for purposes of receiving and retaining a closure member or bottle cap 13. Bottle cap 13 is internally threaded and, in use, is screwed down onto the threaded portion of neck 11 for purposes of keeping the beverage contained in the bottle 12. For hooking purposes, the combination hook and wrench 10 is clamped onto the bottle neck 11 below the lower extremity of bottle cap 13 when cap 13 is fully screwed onto the neck 11.

The combination bottle hook and bottle cap wrench 10 is comprised of an L-shaped piece of solid plastic material having a first leg 14 and a second leg 15 extending at substantially right angles relative to one another. The first leg 14 is a flat elongated member having an enlarged open-ended C-shaped head portion 16 for pushing onto and clamping around the neck 11 of drink bottle 12 when it is desired to hook drink bottle 12 onto a supporting structure (not shown).

The second leg 15 is a flat elongated member providing a retaining member for placement behind a portion of a structure (not shown) on which it is desired to hook the drink bottle 12. For example, the second leg 15 may be placed inside a person's belt, waistband or pants pocket for hooking or clipping the drink bottle 12 to the person when he is walking, hiking, jogging, skating, or engaged in some other physical activity and would like to have his hands free. As further examples, the second leg 15 may be used to hook the drink bottle 12 over a handlebar or frame member of an exercise machine, over a handlebar of a bicycle, over the side of a golf bag, and so forth.

The L-shaped piece of plastic material formed by legs 14 and 15 and head portion 16 is a single molded piece of plastic material. It is made of a rigid plastic material having a small amount of flexibility for enabling the head portion 16 to slip over the neck 11 of drink bottle 12. In this regard, the area encompassed by the head portion 16 is of circular shape having a diameter corresponding to the diameter of the neck 11 of drink bottle 12. The C-shaped head portion 16 is constructed to extend substantially more than 180 degrees around the neck of the drink bottle 12 and, as mentioned, the plastic material is provided with a small amount of flexibility for enabling the C-shaped head portion 16 to snap over the neck 11 of drink bottle 12. Head portion 16 is sized to provide a firm, snug fit with the neck 11.

Figure 2:
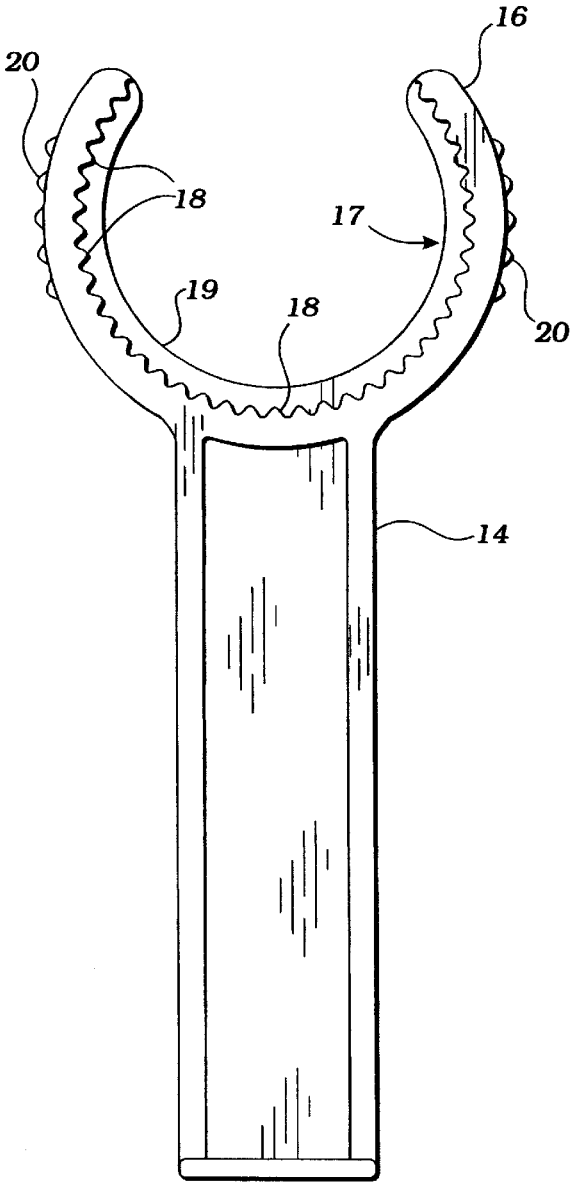
FIG. 2 is a bottom plan view of the combination bottle hook and wrench of FIG. 1.
Figure 3:
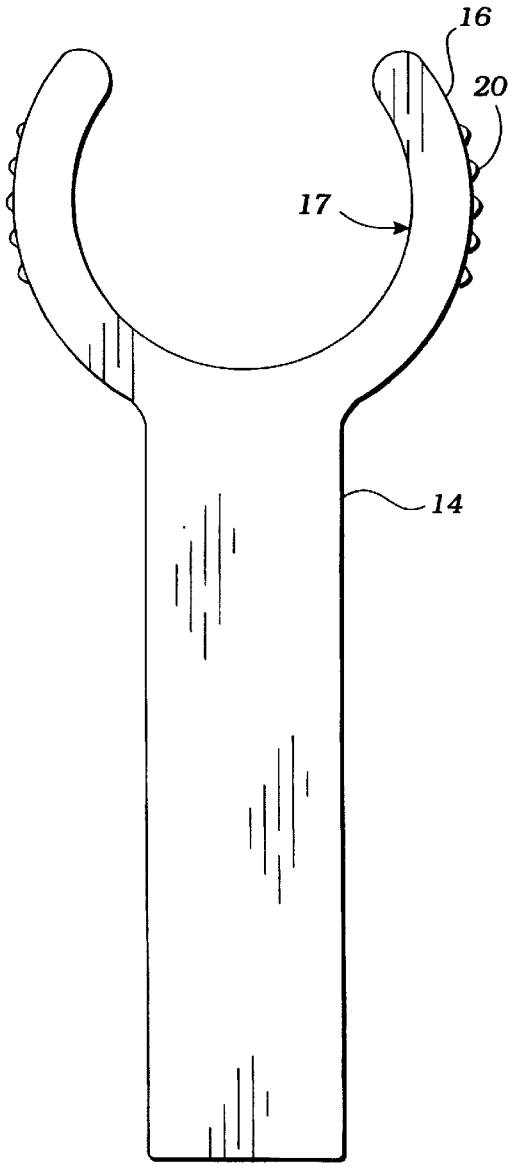
FIG. 3 is a top plan view of the combination bottle hook and wrench of FIG. 1.
Figures 4, 5, 6:
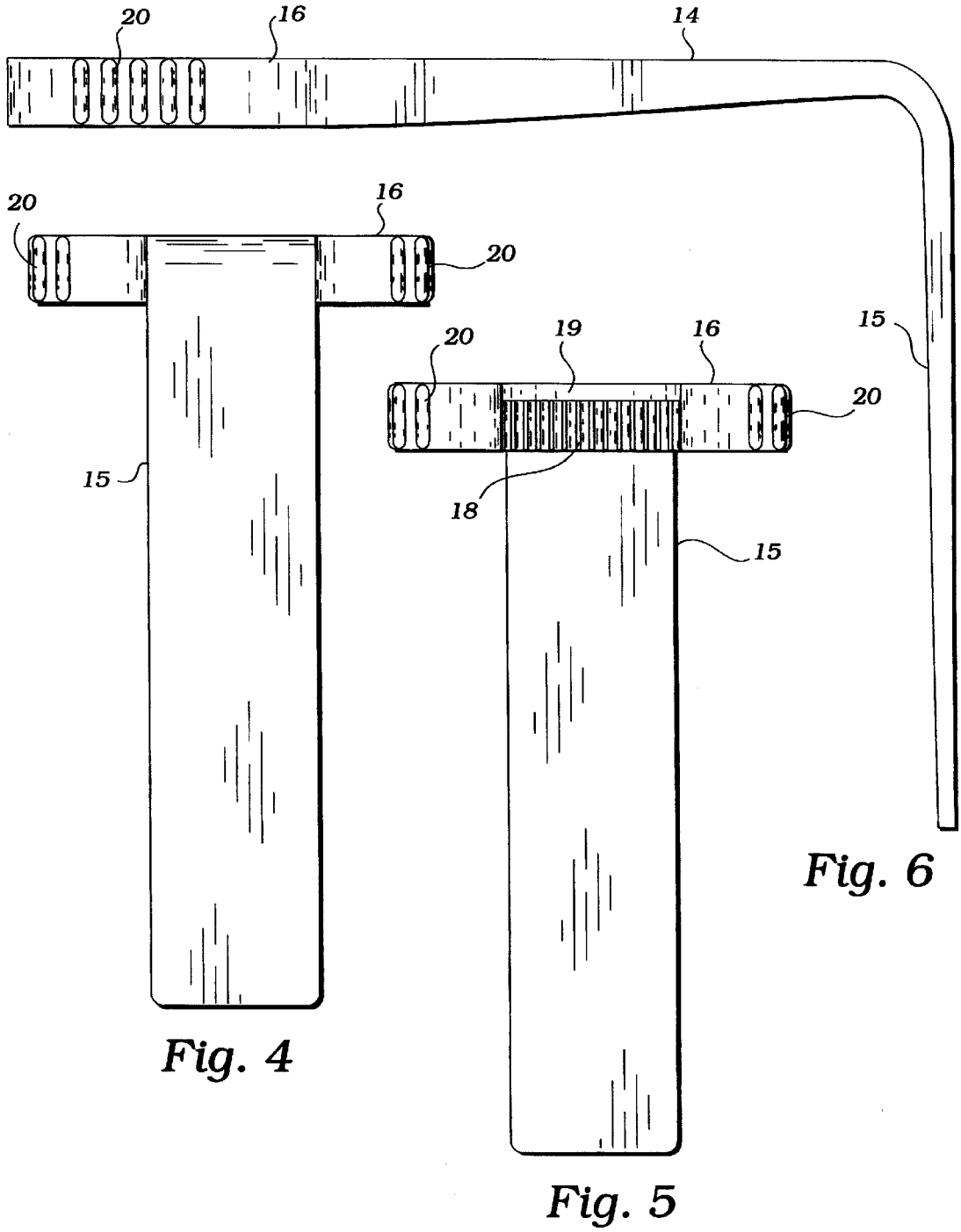
FIG. 4 is a rear elevational view of the combination bottle hook and wrench of FIG. 1.
FIG. 5 is a front elevational view of the combination bottle hook and wrench of FIG. 1.
FIG. 6 is a first side elevational view of the combination bottle hook and wrench of FIG. 1, the other side being a mirror image of FIG. 6.

The L-shaped piece of plastic material formed by legs 14 and 15 and head portion 16 is further provided with a wrench mechanism for use in loosening the bottle cap 13. In particular, the inner surface 17 of the C-shaped head portion 16 is serrated or notched for providing a gripping mechanism for gripping the exterior of bottle cap 13. Individual serrations are indicated at 18. They are like a series of short grooves which extend vertically along the inner surface 17, as shown in FIGS. 1 and 5. As shown in FIG. 5, they extend upward from the bottom of the head portion 16 to an inwardly extending shoulder portion 19 located at the top of head portion 16. The extent of shoulder portion 19 relative to the serrations 18 is best seen in the bottom view of FIG. 2. Also, as seen in FIG. 2, serrations 18 are located all around the inner surface 17 of head portion 16.

Two irregular finger gripping areas 20 are formed on the outside surface of head portion 16, one area 20 being formed on the left side and the other area 20 being formed on the right side of head portion 16. These irregular finger gripping surfaces 20 may be roughened surface areas, serrated surface areas or, as shown, a series of vertically-extending ridges 20 formed on the outer surface of the C-shaped head portion 16. These irregular finger gripping areas 20 aid the user in gripping the head portion 16 with his fingers.

Figure 7:
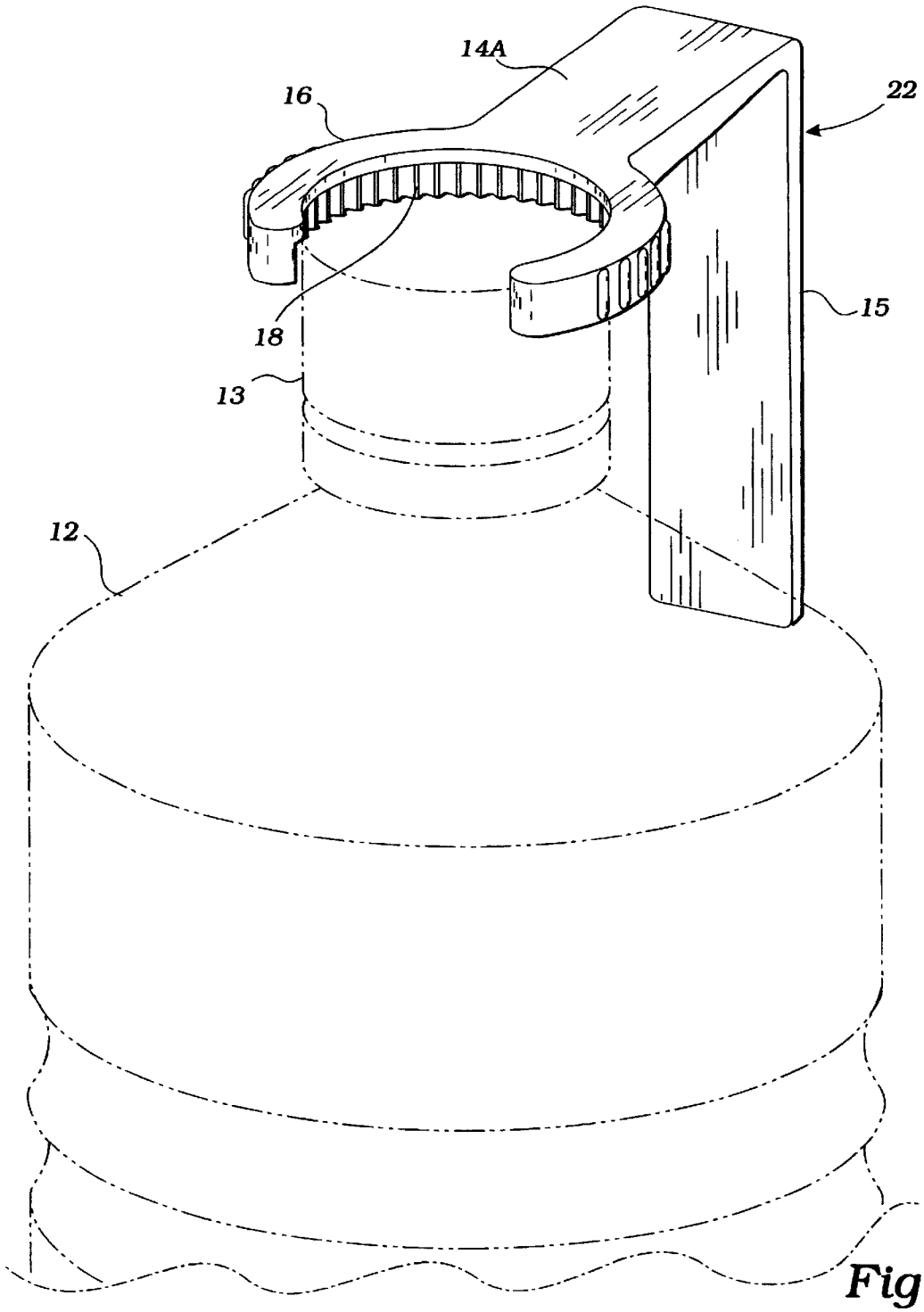
FIG. 7 is a perspective view of a second embodiment of a combination bottle hook and bottle cap wrench constructed in accordance with the present invention, the combination being shown in a bottle cap loosening position.
Figure 8:
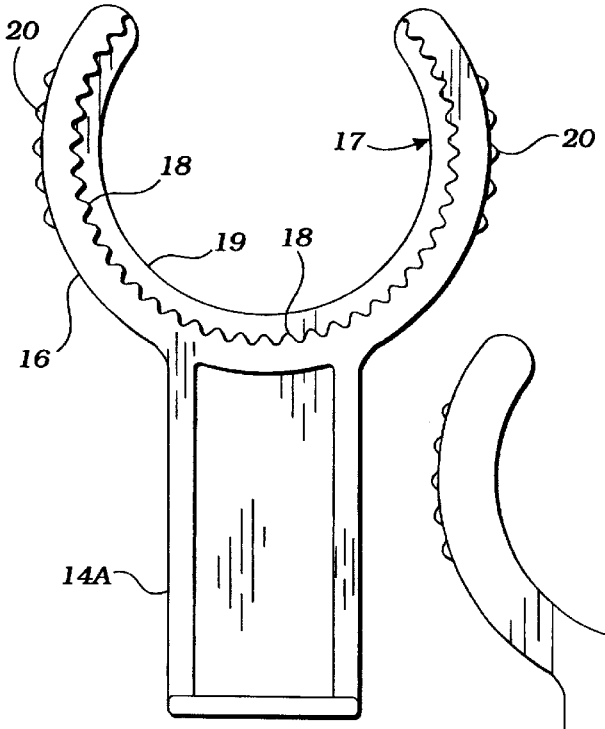
FIG. 8 is a bottom plan view of the combination bottle hook and wrench of FIG. 7.
Figure 9:
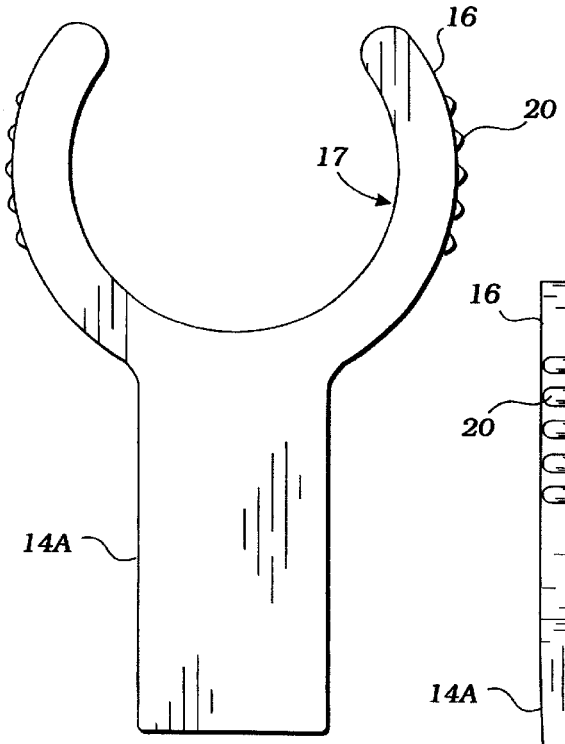
FIG. 9 is a top plan view of the combination bottle hook and wrench of FIG. 7.
Figure 10:
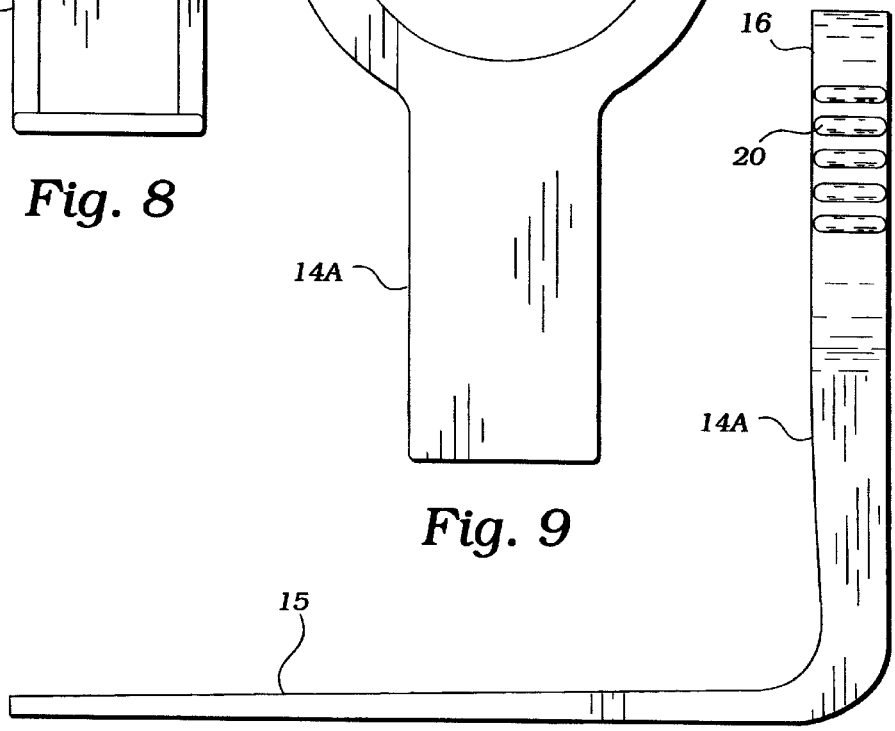
FIG. 10 is a first side elevational view of the combination bottle hook and wrench of FIG. 7, the other side being a mirror image of FIG. 10.

The manner of using the wrench feature is shown in FIG. 7. The head portion 16 is placed down over the bottle cap 13 so that the serrations 18 grip the bottle cap 13. The user grips the exterior irregular areas 20 on the two sides of head portion 16 with his fingers and squeezes inwardly. The user then twists the whole assembly in the proper direction to loosen the bottle cap 13. After the bottle cap 13 is loosened sufficiently, the head portion 16 is removed from the bottle cap 13 and, when the user is ready (after taking a drink or whatever), the head portion 16 is pushed onto the neck 11 of the drink bottle 12 to assume the hooking position shown in FIG. 1. In this regard, if the head portion 16 is initially clamped to the neck of the drink bottle 12, as shown in FIG. 1, then it is removed from the neck before it is placed on the bottle cap for wrenching purposes.

FIGS. 7–10 show a second embodiment 22 of a combination bottle hook and bottle cap wrench constructed in accordance with the present invention. Elements which are substantially the same as those shown for the first embodiment are identified by the same reference numerals as used for the first embodiment. Elements which are different are identified by adding the letter "A" to the numeral (for example, "14A"). The primary difference between embodiments is that the first leg 14A of the L-shaped piece in FIG. 7 is less than one-half the length of the first leg 14 of FIG. 1. This shorter length for the first leg is preferable for clipping the drink bottle 12 on the belt or waistband of the user.

While there has been described what are at present considered to be preferred embodiments of this invention, it will be obvious to those skilled in the art that various changes and modifications may be made therein without departing from the invention and it is, therefore, intended to cover all such changes and modifications as come within the true spirit and scope of the invention.

What is claimed is:

1. A combination bottle hook and bottle cap wrench for a drink bottle having a threaded neck portion and a bottle cap threaded thereon, such combination comprising:

an L-shaped piece of plastic material having first and second legs extending at substantially right angles relative to one another;

the first leg being a flat elongated member having an enlarged open-ended C-shaped head portion for pushing onto and clamping around a neck of the drink bottle for bottle hooking purposes;

and the second leg being a flat elongated member providing a retaining member for placement behind a portion of a structure on which it is desired to hook the drink bottle.

2. The combination of claim 1 wherein the L-shaped piece is made of a rigid plastic material having a small amount of flexibility for enabling the C-shaped head portion to slip over the neck of the drink bottle.

3. The combination of claim 1 wherein the area encompassed by the C-shaped head portion is of circular shape having a diameter corresponding to the diameter of the neck of the drink bottle.

4. The combination of claim 1 wherein the C-shaped head portion is constructed to extend substantially more than 180 degrees around the neck of the drink bottle and the plastic material is provided with a small amount of flexibility for enabling the C-shaped head portion to snap over the neck of the drink bottle.

5. The combination of claim 1 wherein an inner surface of the C-shaped head portion is serrated or notched for placement on the bottle cap of the drink bottle for enabling the piece of plastic material to be used as a wrench for purposes of loosening the bottle cap.

6. The combination of claim 1 wherein an outer surface of the C-shaped head portion is provided with an irregular finger gripping surface for enhancing a gripping of the head portion for enabling the piece of plastic material to be used as a wrench for purposes of loosening the bottle cap.

7. The combination of claim 1 wherein the second leg provides a retaining member for placement inside a person's belt, waistband or pocket, over a handlebar or frame member of an exercise machine, over a side of a golf bag, or over a portion of some other structure on which it is desired to hook the drink bottle.

8. A combination bottle hook and bottle cap wrench for a drink bottle having a threaded neck portion and a bottle cap threaded thereon, such combination comprising:

an L-shaped piece of plastic material having first and second legs extending at substantially right angles relative to one another;

the first leg being a flat elongated member having an enlarged open-ended C-shaped head portion for pushing onto and clamping around a neck of the drink bottle for bottle hooking purposes;

a series of lateral grooves being formed on the inner surface of the C-shaped head portion for gripping a bottle cap of the drink bottle for enabling the piece of plastic material to be used as a wrench for purposes of loosening the bottle cap;

and the second leg being a flat elongated member providing a retaining member for placement behind a portion of a structure on which it is desired to hook the drink bottle.

9. The combination of claim 8 wherein the L-shaped piece is made of a rigid plastic material having a small amount of flexibility for enabling the C-shaped head portion to slip over the neck of the drink bottle.

10. The combination of claim 8 wherein the C-shaped head portion is constructed to extend substantially more than 180 degrees around the neck of the drink bottle and the plastic material is provided with a small amount of flexibility for enabling the C-shaped head portion to snap over the neck of the drink bottle.

11. The combination of claim 8 wherein an outer surface of the C-shaped head portion is provided with an irregular finger gripping surface for enhancing a gripping of the head portion for enabling the piece of plastic material to be used as a wrench for purposes of loosening the bottle cap.

12. A combination bottle hook and bottle cap wrench for a drink bottle having a threaded neck portion and a bottle cap threaded thereon, such combination comprising:

an L-shaped piece of plastic material having first and second legs extending at substantially right angles relative to one another;

the first leg being a flat elongated member having an enlarged open-ended C-shaped head portion for pushing onto and clamping around a neck of the drink bottle for bottle hooking purposes;

an outer surface of the C-shaped head portion being provided with an irregular finger gripping surface for enhancing a gripping of the head portion for enabling the piece of plastic material to be used as a wrench for purposes of loosening the bottle cap;

and the second leg being a flat elongated member providing a retaining member for placement behind a portion of a structure on which it is desired to hook the drink bottle.

13. The combination of claim 12 wherein an inner surface of the C-shaped head portion is serrated or notched for placement on a bottle cap of the drink bottle for enabling the piece of plastic material to be used as a wrench for purposes of loosening the bottle cap.

14. The combination of claim 12 wherein the irregular finger gripping surface is formed on the outer surface on both sides of the C-shaped head portion.

15. The combination of claim 12 wherein the irregular finger gripping surface is a roughened surface area formed on the outer surface of the C-shaped head portion.

16. The combination of claim 15 wherein the roughened surface area is formed on the outer surface on both sides of the C-shaped head portion.

17. The combination of claim 12 wherein the irregular finger gripping surface is a serrated surface portion formed on the outer surface of the C-shaped head portion.

18. The combination of claim 17 wherein the serrated surface portion is formed on the outer surface on both sides of the C-shaped head portion.

19. The combination of claim 12 wherein the irregular finger gripping surface is comprised of a series of vertically-extending ridges formed on the outer surface of the C-shaped head portion.

20. The combination of claim 19 wherein the vertically-extending ridges are formed on the outer surface on both sides of the C-shaped head portion.

* * * * *